US007061833B2

(12) United States Patent
Dierenbach

(10) Patent No.: US 7,061,833 B2
(45) Date of Patent: Jun. 13, 2006

(54) CLOCKS WITH UNIQUE TIME DISPLAYS WHICH ARE INTERPRETED BY THE USE OF TRADITIONAL CLOCK INTERPRETATION MEANS

(76) Inventor: Karl Allen Dierenbach, 232 McCaslin Blvd. #100, Louisville, CO (US) 80027

( * ) Notice: Subject to any disclaimer, the term of this patent is extended or adjusted under 35 U.S.C. 154(b) by 52 days.

(21) Appl. No.: 10/646,214

(22) Filed: Aug. 25, 2003

(65) Prior Publication Data

US 2005/0047280 A1 Mar. 3, 2005

(51) Int. Cl.
*G04B 19/00* (2006.01)

(52) U.S. Cl. ..... 368/76; 368/77; 368/233

(58) Field of Classification Search ..... 368/76–77, 368/233–234

See application file for complete search history.

(56) References Cited

U.S. PATENT DOCUMENTS 1,475,800 A * 11/1923 Creasy ..... 368/233
2,153,004 A 4/1939 Rodanet
2,466,312 A * 4/1949 Heintz ..... 368/77
2,886,942 A 5/1959 Stucky
3,668,858 A * 6/1972 Hartwig ..... 368/77
3,890,777 A * 6/1975 Stanish ..... 368/77
3,934,405 A * 1/1976 Baker ..... 368/233
4,428,682 A * 1/1984 Winter ..... 368/238
4,726,000 A * 2/1988 Weiss ..... 368/80
5,349,572 A 9/1994 Belik
5,359,578 A * 10/1994 Truini ..... 368/76
5,602,803 A * 2/1997 Chaut ..... 368/223
5,751,663 A 5/1998 Johnson
5,999,496 A 12/1999 Chaut

* cited by examiner

*Primary Examiner*—Kamand Cuneo
*Assistant Examiner*—Thanh S. Phan

(57) ABSTRACT

Apparatus for the display of time with a distinctive aesthetic character that includes clear, rigid rotating indicator rings (22) and (24) which are externally driven by a clockwork (30). The clockwork (30) rotates drive wheels (26) and (28) so that the rigid rotating members (22) and (24) indicate the current time and the time is interpreted using traditional clock interpretation means. A demarcation ring (20) is added to assist in the interpretation of the indicated time.

15 Claims, 8 Drawing Sheets

Section A-A

Section B-B

Section C-C

Section D-D

Section E-E

*Section F-F*

CLOCKS WITH UNIQUE TIME DISPLAYS WHICH ARE INTERPRETED BY THE USE OF TRADITIONAL CLOCK INTERPRETATION MEANS

CROSS-REFERENCE TO RELATED APPLICATIONS

Not Applicable

FEDERALLY SPONSORED RESEARCH

Not Applicable

SEQUENCE LISTING OR PROGRAM

Not Applicable

BACKGROUND OF THE INVENTION-FIELD OF INVENTION

The present invention relates to clocks, specifically to clocks with unique time displays that are interpreted through traditional means.

BACKGROUND OF THE INVENTION

For centuries man has designed and built clocks which served the dual purpose of indicating the current time and adding to the aesthetic decor of an area.

Traditionally, mechanical clocks, whether driven by weights, springs and/or electrical energy, have consisted of a clock face and a number of hands rotating about a central point on the clock face. The hour hand is typically shorter and completes one revolution every twelve hours. The minute hand is typically larger and completes one revolution every sixty minutes. To aid in the user's interpretation of the device, the clock face usually features time demarcations. This configuration is ubiquitous and is popular in architectural clocks, wall clocks, desk clocks, and wrist watches.

Many clock designers, such as in U.S. Pat. No. 2,153,004, by C. H. H. Rodanet, issued Apr. 4, 1939, seek to achieve aesthetic distinction by altering the symbols used on the clock face and/or by designing uniquely shaped hands. That clock also featured hands attached to rotating disks to give the appearance that the hands were floating.

Other clock designers, such as in U.S. Pat. No. 5,999,496, by Y. Chaut, issued Dec. 7, 1999, seek to achieve aesthetic appeal through a unique configuration of elements that do not feature hands or traditional clock faces. While aesthetically striking, these clocks do not allow the use of traditional clock interpretation means to determine the indicated time.

There remains a need, and it would be advantageous to have, clocks which are aesthetically unique and do not possess traditional faces or hands, but nonetheless are interpreted using traditional clock interpretation means.

BACKGROUND OF THE INVENTION-OBJECTS AND ADVANTAGES

Accordingly, objects and advantages of my invention include:

(a) to provide a clock with a unique design which is easily read using traditional clock interpretation means;

(b) to provide a clock where the indicators are set by placing the indicators in the correct orientation, thereby simplifying the clockwork by no longer requiring a clock-setting mechanism;

(c) to provide a clock which is configurable by the reversal or removal of a background ring;

(d) to provide a wall clock which appears to have no supporting frame whatsoever and appears to float and is easily read using traditional clock interpretation means.

Still further objects and advantages will become apparent from a consideration of the ensuing description and drawings.

BRIEF SUMMARY OF THE INVENTION

In accordance with the present invention an apparatus for the display of time wherein rigid rings and/or disks are externally driven yielding a distinctive aesthetic character while allowing for traditional clock interpretation means to determine indicated time.

DETAILED DESCRIPTIONS—FIGS. 1 AND 2—PREFERRED EMBODIMENT

Figure 1:
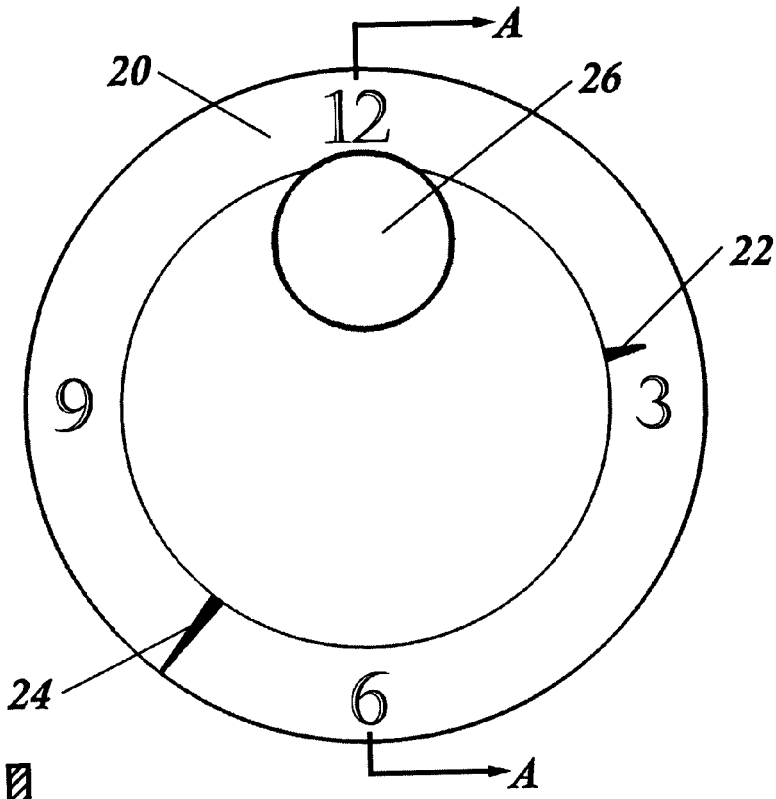
FIG. 1 shows an apparatus for the display of time using two clear rigid rings with indicators for hour and minute, a stationary rigid ring with numerals to aid in the interpretation of the indicated time and a driving mechanism which rotates the two clear rigid rings by acting on the inner annular surfaces of the two clear rigid rings.
Figure 2:
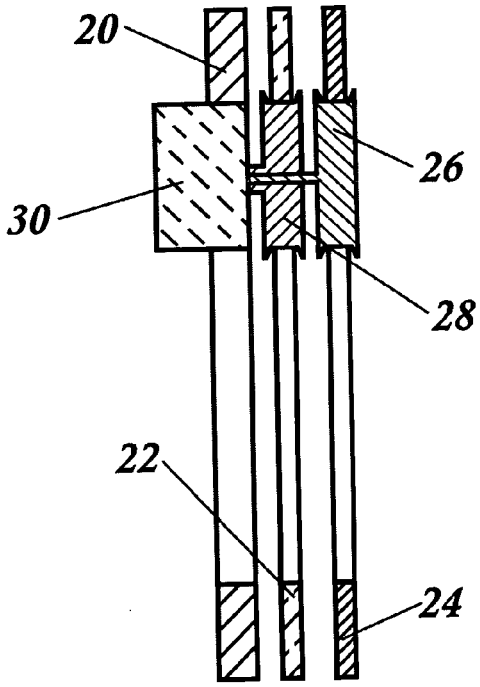
FIG. 2 shows a section view of the apparatus of FIG. 1.

A preferred embodiment of the clock with unique time display of the present invention is illustrated in FIG. 1 (front view) and FIG. 2 (section view). The motion of the clock is driven by a clockwork 30 that drives a minute indicator drive wheel 26 and an hour indicator drive wheel 28. The clockwork 30 can be mounted on a wall or a frame to allow the demarcation ring 20, the minute indicator ring 24 and the hour indicator ring 22 to hang freely.

In the preferred embodiment, the demarcation ring 20 has the numerals 3, 6, 9, and 12 placed at their corresponding clock positions to aid the viewer in the determination of the indicated time. Alternately, all of the clock numerals 1 through 12, roman numerals, or other graphic indication could be used on the demarcation ring 20 to aid the viewer in the determination of the indicated time. The demarcation ring 20 is not a driven member and does not move. The demarcation ring 20 rests on the body of the clockwork 30.

In the preferred embodiment, the minute indicator ring 24 and the hour indicator ring 22 are constructed of a clear material which allows for the demarcation ring 20 to be viewed through the minute indicator ring 24 and the hour indicator ring 22. The minute indicator ring 24 has an indicator to denote the minute of the hour. The indicator can be either printed on, attached to, or machined into the minute indicator ring 24. Likewise the hour indicator ring 22 also has an indicator which is smaller than the indicator on the minute indicator ring 24 to denote the hour. The indicator can be either printed on, attached to, or machined into the hour indicator ring 22.

The minute indicator drive wheel 26 and an hour indicator drive wheel 28 have small flanges which keep the minute indicator ring 24 and the hour indicator ring 22 properly aligned with respect to each other and the demarcation ring 20. The clockwork 30 rotationally drives the minute indicator drive wheel 26 at a rate such that the minute indicator ring 24 is rotated 360 degrees every 60 minutes. The clockwork 30 rotationally drives the hour indicator drive wheel 28 at a rate such that the hour indicator ring 22 is rotated 360 degrees every 12 hours. The resulting effect is that the clock has a unique design that does not have the traditional clock hands, yet the time is interpreted using traditional clock interpretation means. In all embodiments, the time is set by manually positioning the time indicating disks, wheels or plates so that the indicators of hour, minute and second are oriented properly. There is no need to have a time adjustment mechanism on the clockworks.

FIGS. 3–16 Additional Embodiments

Figure 3:
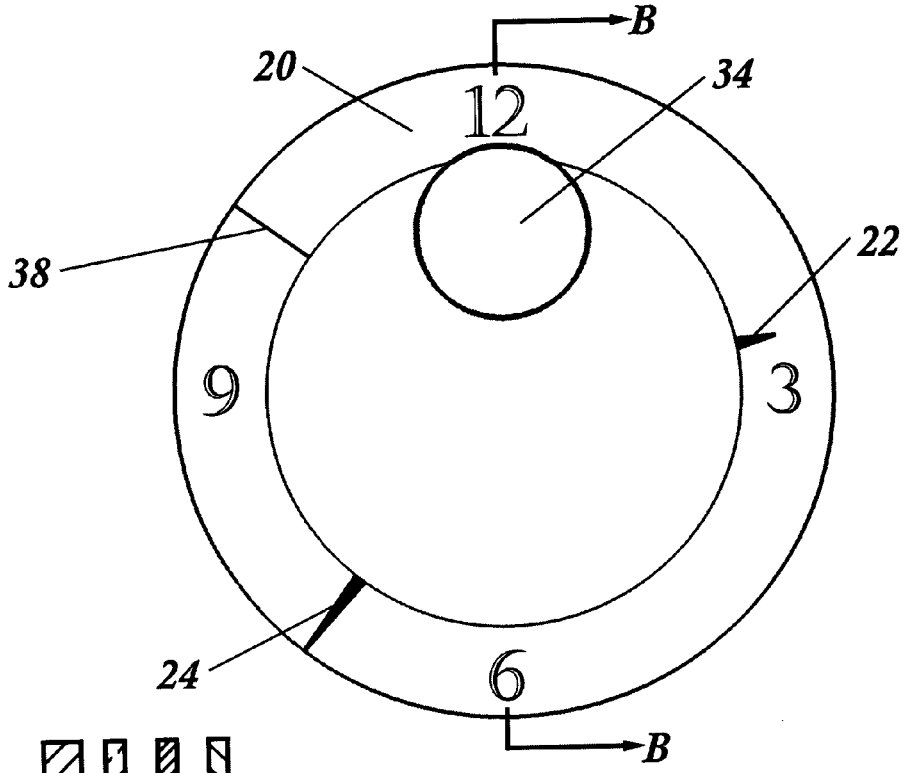
FIG. 3 shows an apparatus similar to that of FIGS. 1 and 2 with a third rigid ring to indicate time and a driving mechanism with additional support at the end of the out put shaft which rotates the three clear rigid rings by acting on the inner annular surfaces of the three clear rigid rings.
Figure 4:
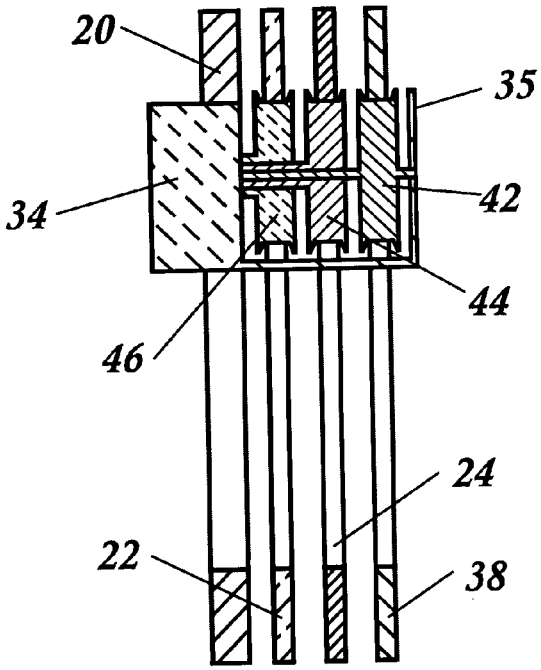
FIG. 4 shows a section view of the apparatus of FIG. 3.

An additional embodiment is shown in FIG. 3 and FIG. 4. This embodiment is substantially similar to the preferred embodiment but with the addition of a third driven wheel, the seconds indicator drive wheel 42, to a clockwork with support arm 34. The seconds indicator drive wheel 42 is constructed of a clear material which allows for the demarcation ring 20, the minute indicator ring 24, and the hour indicator ring 22 to be viewed through the seconds indicator ring 38. The seconds indicator ring 38 has an indicator to denote the second of the minute. The indicator can be either printed on, attached to, or machined into the seconds indicator ring 38.

The seconds indicator drive wheel 42 has small flanges that keep the seconds indicator ring 38 aligned with respect to the minute indicator ring 24, the hour indicator ring 22, and the demarcation ring 20. The clockwork with support arm 34 rotationally drives the seconds indicator drive wheel 42 at a rate such that the seconds indicator ring 38 is rotated 360 degrees every minute. The clockwork with support arm 34 has a support arm 35 extending from the body of the clockwork and supporting the far end of the drive shaft for the drive wheels 42, 44 and 46. The resulting effect is that the clock has a unique design that does not have the traditional clock hands, yet the time is interpreted using traditional clock interpretation means.

Figure 5:
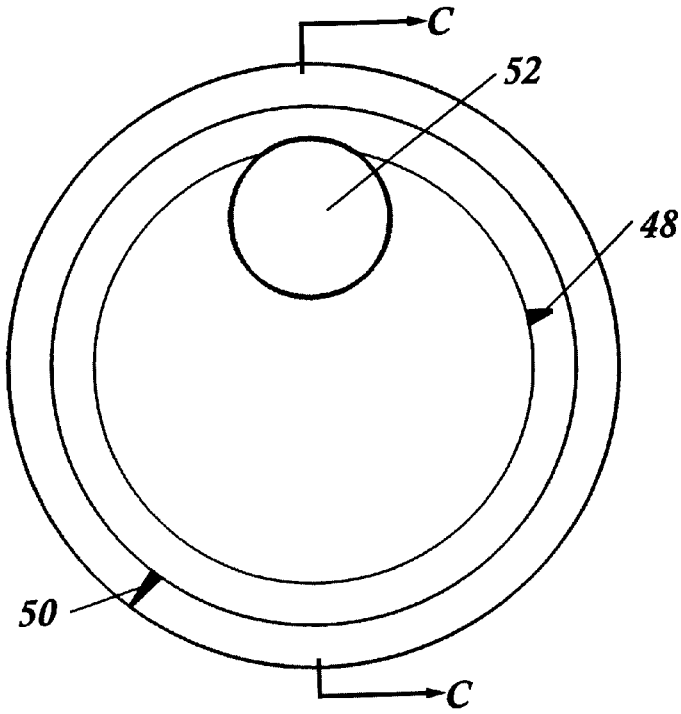
FIG. 5 shows an apparatus for the display of time using two opaque rigid rings with indicators for hour and minute and a driving mechanism, which rotates the two opaque rigid rings by acting on the inner annular surfaces of the two opaque rigid rings.
Figure 6:
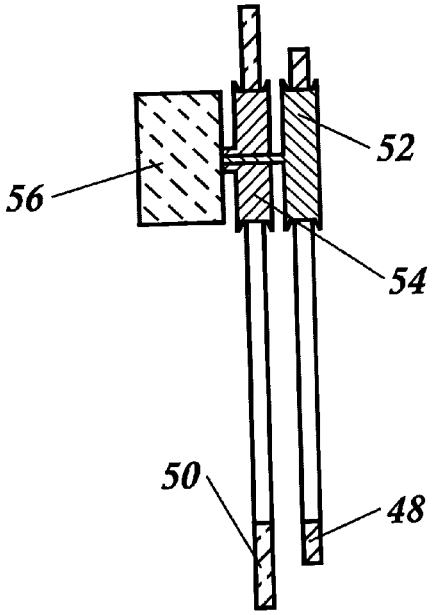
FIG. 6 shows a section view of the apparatus of FIG. 5.

An additional embodiment is shown in FIG. 5 and FIG. 6. In this embodiment of the clock with unique time display the motion of the clock is driven by a clockwork 56 that drives a minute indicator drive wheel 54 and an hour indicator drive wheel 52. The clockwork 56 can be mounted on a wall or a frame to allow the minute indicator ring 50 and the small hour indicator ring 48 to hang freely. The minute indicator ring 50 and the small hour indicator ring 48 are constructed of a opaque material. The minute indicator ring 50 has an indicator to denote the minute of the hour. The indicator can be either printed on, attached to, or machined into the minute indicator ring 50. Likewise the small hour indicator ring 48 also has an indicator which is smaller than the indicator on the minute indicator ring 50 to denote the hour. The indicator can be either printed on, attached to, or machined into the small hour indicator ring 48.

The minute indicator drive wheel 54 and an hour indicator drive wheel 52 have small flanges which keep the minute indicator ring 50 and the small hour indicator ring 48 properly aligned with respect to each other. The clockwork 56 rotationally drives the minute indicator drive wheel 54 at a rate such that the minute indicator ring 50 is rotated 360 degrees every 60 minutes. The clockwork 56 rotationally drives the hour indicator drive wheel 52 at a rate such that the small hour indicator ring 48 is rotated 360 degrees every 12 hours. The small hour indicator ring 48 is sized so that the indicator on the minute indicating ring 50 is not blocked from view. The resulting effect is that the clock has a unique design that does not have the traditional clock hands, yet the time is interpreted using traditional clock interpretation means.

Figure 7:
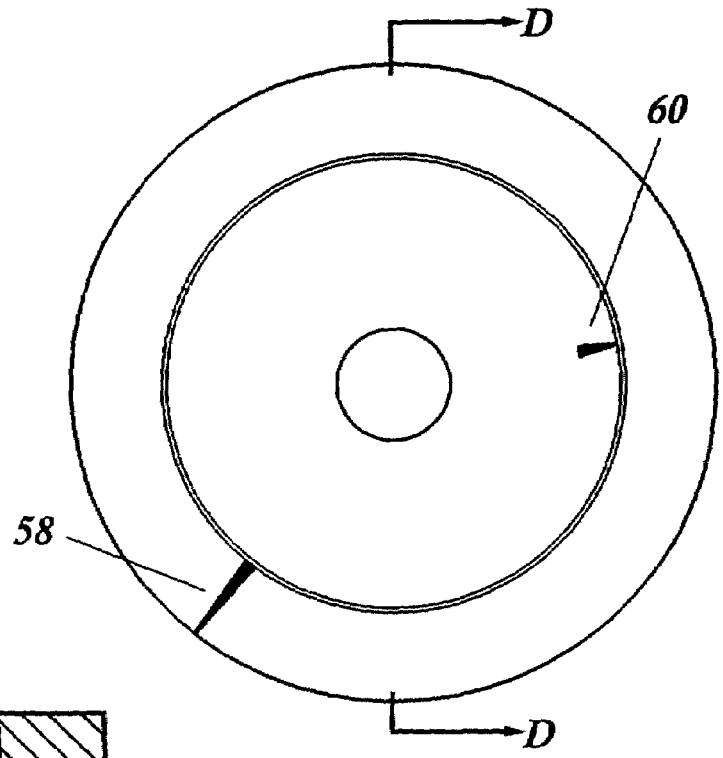
FIG. 7 shows an apparatus for the display of time using two opaque rigid annular parts with indicators for hour and minute, said annular parts being configured in a manner which hides a driving mechanism which rotates the two opaque rigid annular parts by acting on the inner annular surfaces of the opaque rigid annular parts.
Figure 8:
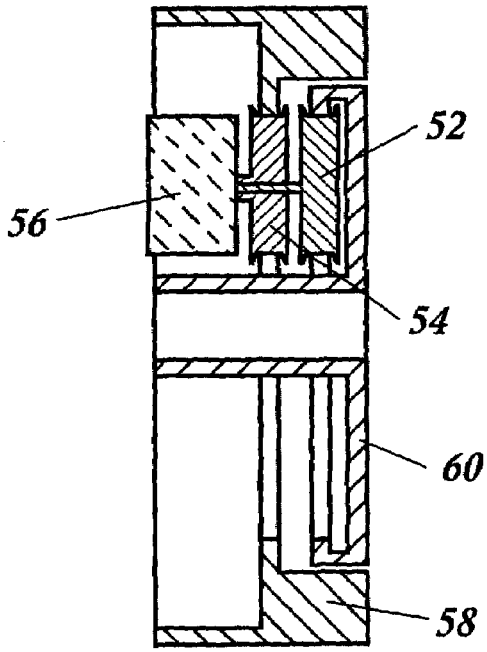
FIG. 8 shows a section view of the apparatus of FIG. 7.

An additional embodiment is shown in FIG. 7 and FIG. 8. In this embodiment the clockwork 56, the minute indicator drive wheel 54 and an hour indicator drive wheel 52 are essentially the same as in the previous embodiment shown in FIG. 5 and FIG. 6. The clockwork 56 can be mounted on a wall or a frame to allow the minute indicator wheel 58 and the hour indicator wheel 60 to hang freely. The minute indicator wheel 58 and the hour indicator wheel 60 are constructed of a opaque material. The minute indicator wheel 58 has an indicator to denote the minute of the hour. The indicator can be either printed on, attached to, or machined into the minute indicator wheel 58. Likewise the hour indicator wheel 60 also has an indicator, which is smaller than the indicator on the minute indicator wheel 58 to denote the hour. The indicator can be either printed on, attached to, or machined into the hour indicator wheel 60.

The clockwork 56 rotationally drives the minute indicator drive wheel 54 at a rate such that the minute indicator wheel 58 is rotated 360 degrees every 60 minutes. The clockwork 56 rotationally drives the hour indicator drive wheel 52 at a rate such that the hour indicator wheel 60 is rotated 360 degrees every 12 hours. The hour indicator wheel 60 is configured such that it masks the clockwork 56 and the drive wheels from view. The minute indicator wheel 58 is configured so that the surface with the minute indicator is coplanar with the surface of the hour indicator wheel 60 with the hour indicator. The resulting effect is to give the unique appearance of floating rings, yet the time is interpreted using traditional clock interpretation means.

Figure 9:
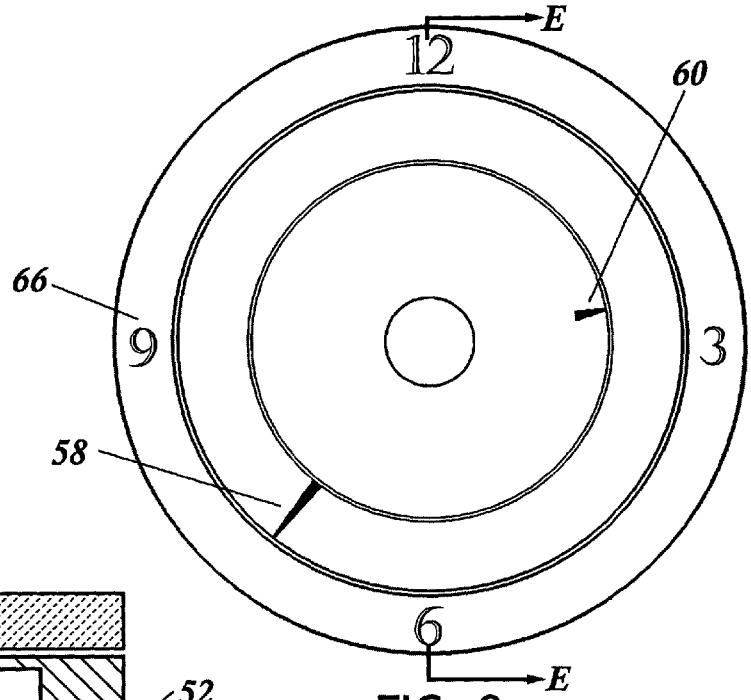
FIG. 9 shows an apparatus for the display of time using two opaque rigid annular parts with indicators for hour and minute said annular parts being configured in a manner which hides a driving mechanism which rotates the two opaque rigid annular parts by acting on the inner annular surfaces of the opaque rigid annular parts, and a third stationary annular part with numerals to aid in the interpretation of the indicated time.
Figure 10:
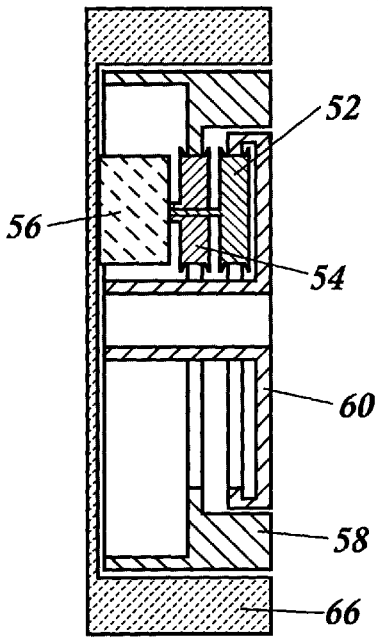
FIG. 10 shows a section view of the apparatus of FIG. 9.

An additional embodiment is shown in FIG. 9 and FIG. 10. This embodiment is essentially the same as that shown in FIG. 7 and FIG. 8 with the addition of a demarcation frame 66. The demarcation frame 66 has the numerals 3, 6, 9, and 12 placed at their corresponding clock positions to aid the viewer in the determination of the indicated time. Alternately, all of the clock numerals 1 through 12, roman numerals, or other graphic indication could be used on the demarcation frame 66 to aid the viewer in the determination of the indicated time. The demarcation frame 66 is not a driven member and does not move. The clockwork 56 is attached to the demarcation frame 66. The demarcation frame 66 can be mounted on a wall or a frame.

Figure 11:
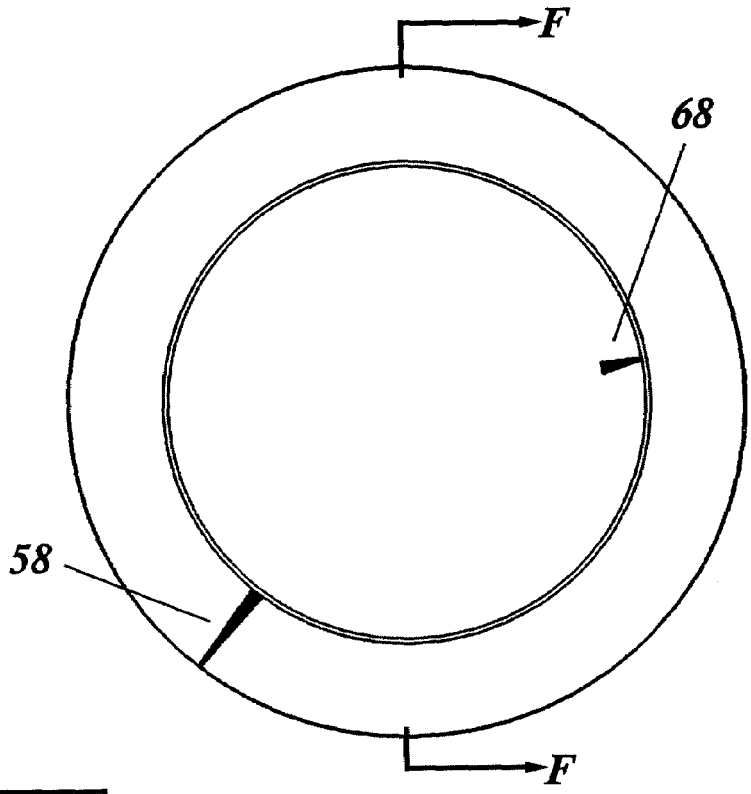
FIG. 11 shows an apparatus for the display of time using an opaque rigid annular part to indicate the minute of the hour and an opaque disk with an indicator for the hour, said annular part and said disk being configured in a manner which hides a driving mechanism which rotates the opaque rigid annular part and the opaque disk by acting on their respective inner annular surfaces.
Figure 12:
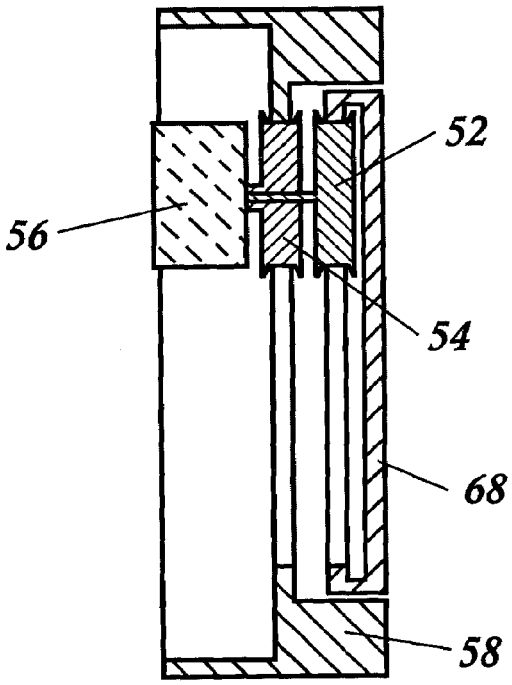
FIG. 12 shows a section view of the apparatus of FIG. 11.

An additional embodiment is shown in FIG. 11 and FIG. 12. This embodiment is essentially the same as that shown in FIG. 7 and FIG. 8 except that the hour indicator wheel 60 has been replaced with an hour indicator plate 68. The hour indicator plate 68 has an indicator that is smaller than the indicator on the minute indicator wheel 58 to denote the hour. The indicator can be either printed on, attached to, or machined into the hour indicator plate 68. The clockwork 56 rotationally drives the hour indicator drive wheel 52 at a rate such that the hour indicator plate 68 is rotated 360 degrees every 12 hours. The hour indicator plate 68 is configured such that it masks the clockwork 56 and the drive wheels from view. The resulting effect is to give the unique appearance of a floating time indication surface, yet the time is interpreted using traditional clock interpretation means.

Figure 13:
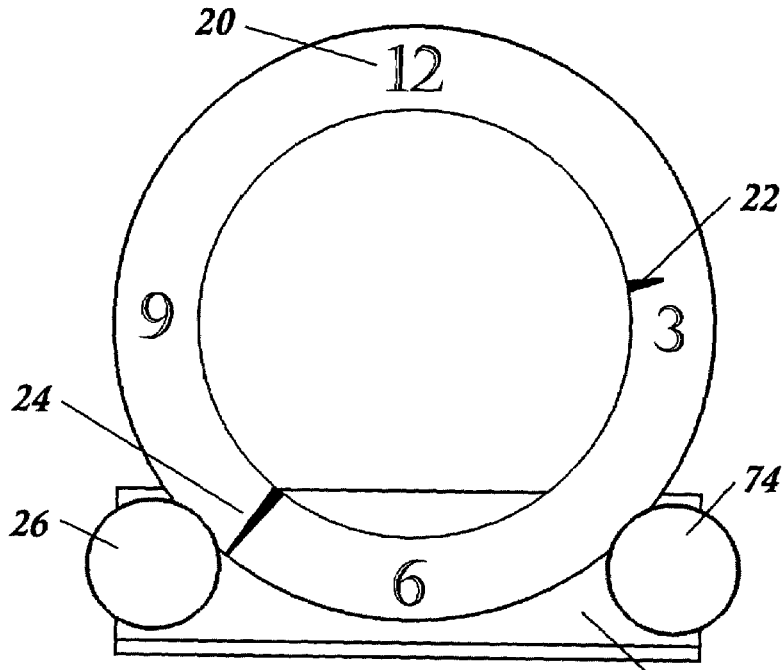
FIG. 13 shows an apparatus for the display of time using two clear rigid rings with indicators for hour and minute, a stationary rigid ring with numerals to aid in the interpretation of the indicated time and a driving mechanism, which rotates the clear rigid rings by acting on their outer annular surfaces.
Figure 14:
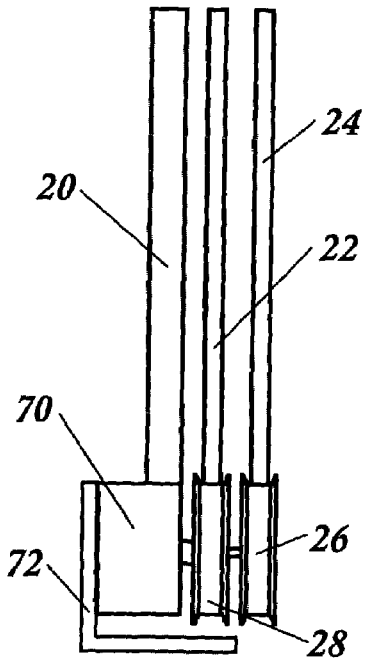
FIG. 14 shows a side view of the apparatus of FIG. 13.

An additional embodiment is shown in FIG. 13 and FIG. 14. This embodiment is comprised of the same demarcation ring 20, minute indicator ring 24, hour indicator ring 22, minute indicator drive wheel 26, and hour indicator drive wheel 28 as the preferred embodiment. However, in this embodiment the minute indicator ring 24 and hour indicator ring 22 are driven respectively by the minute indicator drive wheel 26 and hour indicator drive wheel 28 on the outside surface of the indicator rings 24 and 22. The outside drive clockwork 70 rotationally drives the minute indicator drive wheel 26 at a rate such that the minute indicator ring 24 is rotated 360 degrees every 60 minutes. The outside drive clockwork 70 rotationally drives the hour indicator drive wheel 28 at a rate such that the hour indicator ring 22 is rotated 360 degrees every 12 hours. The minute indicator ring 24 and hour indicator ring 22 are held against the drive wheels and idler wheels 74 by the force of gravity. The idler wheels 74 rotate freely about an axis through their centers. The demarcation ring 20 rests on the outside drive clockwork 70 body and an idler wheel 74 and is not driven.

The demarcation ring 20 has the numerals 3, 6, 9, and 12 placed at their corresponding clock positions to aid the viewer in the determination of the indicated time. Alternately, all of the clock numerals 1 through 12, roman numerals, or other graphic indication could be used on the demarcation ring 20 to aid the viewer in the determination of the indicated time. The demarcation ring 20 is not a driven member and does not move. The demarcation ring 20 rests on the body of the clockwork 30.

The minute indicator ring 24 and the hour indicator ring 22 are constructed of a clear material which allows for the demarcation ring 20 to be viewed through the minute indicator ring 24 and the hour indicator ring 22. The minute indicator ring 24 has an indicator to denote the minute of the hour. The indicator can be either printed on, attached to, or machined into the minute indicator ring 24. Likewise the hour indicator ring 22 also has an indicator, which is smaller than the indicator on the minute indicator ring 24 to denote the hour. The indicator can be either printed on, attached to, or machined into the hour indicator ring 22. The minute indicator drive wheel 26 and an hour indicator drive wheel 28 have small flanges which keep the minute indicator ring 24 and the hour indicator ring 22 properly aligned with respect to each other and the demarcation ring 20. The outside drive clockwork 70 and idler wheels 74 are mounted to a support frame 72 which in turn can be placed in a horizontal surface, such as a desk for use as a desk clock, or attached to a wall for use as a wall clock. The resulting effect is that the clock has a unique design that does not have the traditional clock hands, yet the time is interpreted using traditional clock interpretation means.

Figure 15:
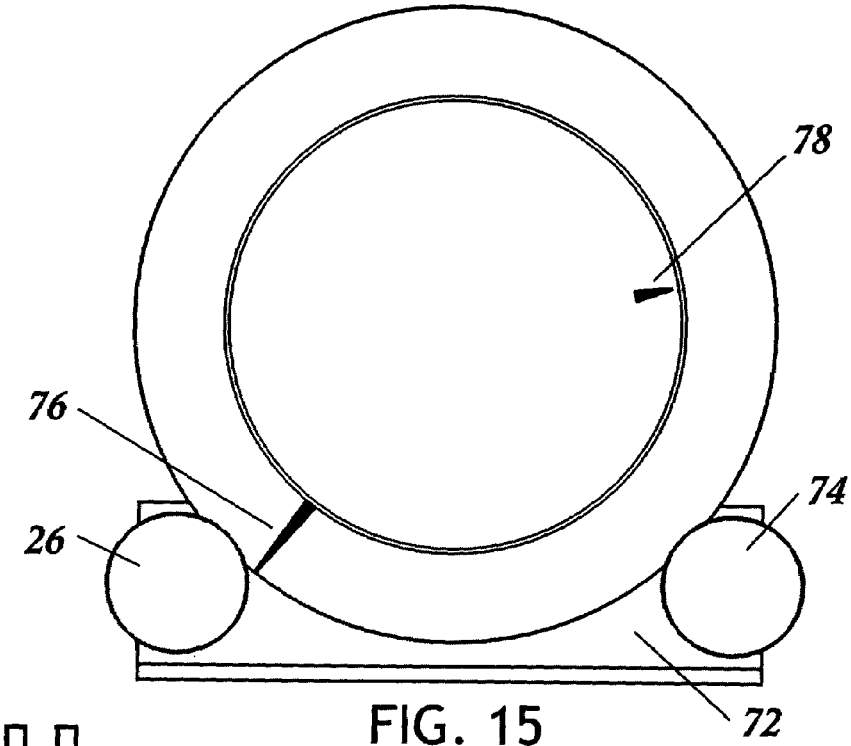
FIG. 15 shows an apparatus for the display of time using an opaque rigid annular part to indicate the minute of the hour and an opaque disk with an indicator for the hour and a driving mechanism, which rotates the opaque rigid annular part and the opaque disk by acting on their respective outer annular surfaces.
Figure 16:
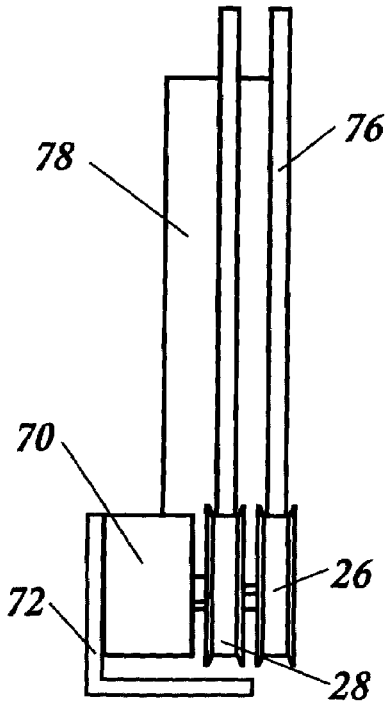
FIG. 16 shows a side view of the apparatus of FIG. 15.

An additional embodiment is shown in FIG. 15 and FIG. 16. This embodiment is comprised of the same outside drive clockwork 70, support frame 72, idler wheels 74, minute indicator drive wheel 26, and hour indicator drive wheel 28 as the previous embodiment. In this embodiment the outside drive clockwork 70 rotationally drives the minute indicator drive wheel 26 at a rate such that an opaque minute indicator ring 76 is rotated 360 degrees every 60 minutes. The outside drive clockwork 70 rotationally drives the hour indicator drive wheel 28 at a rate such that an hour indicator disk 78 is rotated 360 degrees every 12 hours. The opaque minute indicator ring 76 and the hour indicator disk 78 are held against the drive wheels and idler wheels 74 by the force of gravity. The idler wheels 74 rotate freely about an axis through their centers.

The opaque minute indicator ring 76 has an indicator to denote the minute of the hour. The indicator can be either printed on, attached to, or machined into the opaque minute indicator ring 76. Likewise the hour indicator disk 78 also has an indicator, which is smaller than the indicator on the opaque minute indicator ring 76 to denote the hour. The indicator can be either printed on, attached to, or machined into the hour indicator disk 78. The minute indicator drive wheel 26 and an hour indicator drive wheel 28 have small flanges which keep the opaque minute indicator ring 76 and the hour indicator disk 78 properly aligned with respect to each other.

The hour indicator disk 78 is a flat circular disk of a width at its outer edge which allows it to ride within the flanges of the hour indicator drive wheel 28. The hour indicator disk 78 is wider in its center so that the surface of the hour indicator disk 78 with the indicator is coplanar with the surface which contains the indicator on the opaque minute indicator ring 76. The hour indicator disk 78 is symmetrical about an axis perpendicular to its rotational axis in order to ensure that the disk remains upright and well balanced when driven by the hour indicator drive wheel 28 and resting on idler wheel 74. The resulting effect is that the clock has a unique design that does not have the traditional clock hands, yet the time is interpreted using traditional clock interpretation means.

Thus the reader will see that the clocks of the invention provide unique designs which are easily read using traditional clock interpretation means. While my above description contains many specificities, these should not be construed as limitations on the scope of the invention, but rather as an exemplification of preferred embodiments thereof. Many other variations are possible. For example, illumination of the rings of the preferred embodiment through the edges of said rings would add aesthetic appeal to the design and allow for time interpretation in low light situations.

Accordingly, the scope of the invention should be determined not by the embodiments illustrated, but by the appended claims and their legal equivalents.

I claim:

1. An apparatus for the display of time, comprising:

(a) a clockwork;

(b) said clockwork having two coaxial output shafts driven at different angular rates (c) two drive wheels, one drive wheel attached to each of said drive shafts (d) a first rigid member with an inner annular surface which is suspended by the first of said drive wheels and has a demarcation to represent the hour, said first rigid member with hour demarcation in contact with said first drive wheel so as to rotate said first rigid member with hour demarcation at a different angular rate than said first drive wheel so that said first rigid member rotates through one complete revolution once every twelve hours allowing the hour to be interpreted using traditional clock interpretation means, said first rigid member being held in contact with said first drive wheel by the force of gravity;

(e) a second rigid member with an inner annular surface which is suspended by the second of said drive wheels and has a demarcation to represent the minute of the hour, said second rigid member with minute demarcation in contact with said second drive wheel so as to rotate said second rigid member with minute demarcation at a different angular rate than said second drive wheel so that said second rigid member rotates through one complete revolution once every hour allowing the minute of the hour to be interpreted using traditional clock interpretation means, said second rigid member being held in contact with said first drive wheel by the force of gravity, wherein said second rigid member rotates about substantially the same rotational axis as said first rigid member.

2. The apparatus of claim 1, wherein said rigid members are substantially clear annular rings, wherein said first rigid member having an inner radius at least ten percent as large as the outer radius of said first rigid member, and said second rigid member having an inner radius at least ten percent as large as the outer radius of said second rigid member.

3. The apparatus of claim 1, wherein said rigid members are substantially clear annular rings and, wherein a stationary third annular ring is mounted behind the clear annular rings wherein said third annular ring has demarcations used to aid in interpretation of the time of day, wherein said first rigid member having an inner radius at least ten percent as large as the outer radius of said first rigid member, and said second rigid member having an inner radius at least ten percent as large as the outer radius of said second rigid member, and said stationary third annular ring having an inner radius at least ten percent as large as the outer radius of said stationary third annular ring.

4. The apparatus of claim 1, wherein said clockwork includes a third output shaft with a third drive wheel attached to said third output shaft, and a third rigid member with an inner annular surface which hangs on said third drive wheel and has a demarcation to represent the second of the minute, said third rigid member with second demarcation in contact with said third drive wheel so as to rotate said third rigid member with second demarcation at a different angular rate than said third drive wheel so that said third rigid member rotates through one complete revolution once every minute allowing the second of the hour to be interpreted using traditional clock interpretation means, said third rigid member being held in contact with said third drive wheel by the force of gravity, wherein said third rigid member rotates about substantially the same rotational axis as said first rigid member.

5. The apparatus of claim 1, wherein said first rigid member with hour demarcation is an annular ring and said second rigid member with minute demarcation is an annular ring, wherein said first rigid member has a smaller outside diameter than said second rigid member with minute demarcation, wherein said first rigid member having an inner radius at least ten percent as large as the outer radius of said first rigid member, and said second rigid member having an inner radius at least ten percent as large as the outer radius of said second rigid member.

6. The apparatus of claim 1, wherein said first rigid member has an inner annular surface to contact the drive wheel which is farthest from the clockwork and comprises of a flange to attach said inner annular surface to a surface perpendicular to the axis of rotation, said surface perpendicular to the axis of rotation being large enough to hide said drive wheel farthest from the clockwork from view and providing an area for a demarcation to indicate time, furthermore wherein said second rigid member is an annular ring having an inner radius at least ten percent as large as the outer radius of said second rigid member.

7. An apparatus for the display of time, comprising:

(a) a support frame;

(b) a clockwork mounted to said support frame;

(c) said clockwork having two coaxial output shafts driven at different angular rates (d) two drive wheels, one drive wheel attached to each of said drive shafts (e) a first rigid member with an outer annular surface which rests on the first of said drive wheels and has a demarcation to represent the hour, said first rigid member with hour demarcation in contact with said first drive wheel so as to rotate said first rigid member with hour demarcation at a different angular rate than said first drive wheel so that said first rigid member rotates through one complete revolution once every twelve hours allowing the hour to be interpreted using traditional clock interpretation means, said first rigid member being held in contact with said first drive wheel by the force of gravity;

(f) a second rigid member with an outer annular surface which rests on the second of said drive wheels and has a demarcation to represent the minute of the hour, said second rigid member with minute demarcation in contact with said second drive wheel so as to rotate said second rigid member with minute demarcation at a different angular rate than said second drive wheel so that said second rigid member rotates through one complete revolution once every hour allowing the minute of the hour to be interpreted using traditional clock interpretation means, said second rigid member being held in contact with said second drive wheel by the force of gravity, wherein said second rigid member rotates about substantially the same rotational axis as said first rigid member.

8. The apparatus of claim 7, wherein said rigid members are substantially clear annular rings, wherein said first rigid member having an inner radius at least ten percent as large as the outer radius of said first rigid member, and said second rigid member having an inner radius at least ten percent as large as the outer radius of said second rigid member.

9. The apparatus of claim 7, wherein said rigid members are substantially clear annular rings and wherein a stationary third annular ring is mounted behind the clear annular rings wherein said third annular ring has demarcations used to aid in interpretation of the time of day, wherein said first rigid member having an inner radius at least ten percent as large as the outer radius of said first rigid member, and said second rigid member having an inner radius at least ten percent as large as the outer radius of said second rigid member, and said third annular ring having an inner radius at least ten percent as large as the outer radius of said third annular ring.

10. The apparatus of claim 7, wherein said clockwork includes a third output shaft with a third driven wheel attached to said third output shaft, and a third rigid member with an inner annular surface which rests on said third drive wheel and has a demarcation to represent the second of the minute, said rigid member with second demarcation in contact with said third drive wheel so as to rotate said rigid member with second demarcation at a different angular rate than said third drive wheel so that said third rigid member rotates through one complete revolution once every minute allowing the second of the hour to be interpreted using traditional clock interpretation means, said third rigid member being held in contact with said third drive wheel by the force of gravity, wherein said third rigid member rotates about substantially the same rotational axis as said first rigid member.

11. The apparatus of claim 7, wherein said second rigid member with minute demarcation is an annular ring and said first rigid member with hour demarcation is an annular ring with a smaller inside diameter than said second rigid member with minute demarcation, wherein said first rigid member having an inner radius at least ten percent as large as the outer radius of said first rigid member, and said second rigid member having an inner radius at least ten percent as large as the outer radius of said second rigid member.

12. The apparatus of claim 7, wherein said first rigid member with hour demarcation is a disk and said second rigid member with minute demarcation is an annular ring, wherein said second rigid member having an inner radius at least ten percent as large as the outer radius of said second rigid member.

13. An apparatus for the display of time,comprising:

(a) a first rigid annular member having an inner radius at least ten percent as large as the outer radius of said first rigid annular member, said first rigid annular member having a demarcation;

(b) a second rigid annular member having an inner radius at least ten percent as large as the outer radius of said second rigid annular member, said second rigid annular member having a demarcation;

(c) a means for rotating said first and second rigid members about substantially the same rotational axis, said first rigid member being rotated through one complete revolution once every twelve hours and said second rigid member being rotated through one complete revolution once every hour, allowing the time of day to be interpreted using traditional clock interpretation means.

14. The apparatus of claim 13, wherein said rigid members are substantially clear.

15. The apparatus of claim 13, wherein said rigid members are substantially clear and, wherein a stationary third annular member is mounted behind the clear annular members wherein said third annular member has demarcations used to aid in interpretation of the time of day.

* * * * *